US010538301B2

(12) United States Patent
Murphy

(10) Patent No.: US 10,538,301 B2
(45) Date of Patent: Jan. 21, 2020

(54) INTEGRAL PEDAL DRIVE FOR WATERCRAFT

(71) Applicant: Feelfree US LLC, Swannanoa, NC (US)

(72) Inventor: Peter James Murphy, Bangkok (TH)

(73) Assignee: JOY SPORTS CO., LTD., Bangkok (TH)

( * ) Notice: Subject to any disclaimer, the term of this patent is extended or adjusted under 35 U.S.C. 154(b) by 7 days.

(21) Appl. No.: 15/970,455

(22) Filed: May 3, 2018

(65) Prior Publication Data

US 2018/0251201 A1 Sep. 6, 2018

Related U.S. Application Data

(63) Continuation of application No. 15/205,744, filed on Jul. 8, 2016, now Pat. No. 9,988,133.

(51) Int. Cl.

| | |
|---|---|
| ***B63H 21/17*** | (2006.01) |
| ***B63H 16/20*** | (2006.01) |
| ***B63B 35/71*** | (2006.01) |
| ***B63H 20/04*** | (2006.01) |
| ***B63H 23/04*** | (2006.01) |
| ***B63H 5/125*** | (2006.01) |
| ***B63H 23/02*** | (2006.01) |

(52) U.S. Cl.

CPC ..... *B63H 16/20* (2013.01); *B63B 35/71* (2013.01); *B63H 5/125* (2013.01); *B63H 20/04* (2013.01); *B63H 23/02* (2013.01); *B63H 23/04* (2013.01); *B63B 2741/00* (2013.01); *B63B 2747/00* (2013.01); *B63H 2016/202* (2013.01)

(58) Field of Classification Search

CPC ..... B63H 21/17; B63H 20/007; B63H 21/20; B63H 2021/202; B63H 2021/205; B63H 2021/207; B63H 23/18

See application file for complete search history.

(56) References Cited

U.S. PATENT DOCUMENTS

| | | | |
|---|---|---|---|
| 3,241,511 | A | 3/1966 | Drtina |
| 4,106,366 | A | 8/1978 | Altenbokum et al. |
| 4,890,811 | A | 1/1990 | Ehni |

(Continued)

FOREIGN PATENT DOCUMENTS

| | | | |
|---|---|---|---|
| FR | 2474995 | A2 | 8/1987 |

*Primary Examiner* — Andrew Polay
(74) *Attorney, Agent, or Firm* — The Webb Law Firm

(57) ABSTRACT

A dual drive system for providing motive power to a watercraft has a frame configured for connecting to the watercraft and a drive assembly connected to the frame. The drive assembly has a manual drive mechanism configured for receiving mechanical input from a user, a motor drive mechanism configured for receiving mechanical input from a motor, a driveshaft having a first end in selective engagement with one of the manual drive mechanism and the motor drive mechanism and a second end in engagement with a propeller, and a drive selector for selectively engaging the manual drive mechanism or the motor drive mechanism with the driveshaft based on a position of the drive selector between first and second positions. In the first position, the drive selector engages the manual drive mechanism with a driveshaft. In the second position, the drive selector engages the motor drive mechanism with the driveshaft.

16 Claims, 10 Drawing Sheets

(56) References Cited

U.S. PATENT DOCUMENTS

| | | | | |
|---|---|---|---|---|
| 5,078,416 | A | 1/1992 | Keyes | |
| 5,542,370 | A | 8/1996 | Castleberry | |
| 7,549,902 | B2 | 6/2009 | Jansen | |
| 2008/0132127 | A1 | 6/2008 | Jansen | |
| 2009/0042461 | A1 | 2/2009 | Walton | |
| 2012/0238159 | A1* | 9/2012 | Palvoelgyi | B63H 16/14 440/1 |
| 2017/0341718 | A1* | 11/2017 | Zimmerman | B63B 35/71 |

* cited by examiner

INTEGRAL PEDAL DRIVE FOR WATERCRAFT

CROSS-REFERENCE TO RELATED APPLICATIONS

This application is a continuation application of United States Application No. 15/205,744 filed Jul. 8, 2016, the disclosure of which is hereby incorporated by reference herein in its entirety.

BACKGROUND OF THE DISCLOSURE

Field of the Disclosure

The present disclosure relates generally to dual drive system, and more specifically to dual drive system having a motor and a mechanical pedal system, wherein drive power can be selectively provided by the motor or by a user via the mechanical pedal mechanism. The dual drive system may be used in small watercraft.

Description of Related Art

Various drive systems for watercraft are known in the art for providing motive power to a watercraft, such as a kayak or a canoe. In some examples, a pedal-powered drive system is provided as an alternative to a watercraft with a gas-powered drive system or an oar-powered drive system. An advantage of pedal-powered drive systems over gas-powered drive system is the pedal-powered drive systems are silent and more environmentally friendly than a gas-powered drive system. In addition, watercraft with pedal-powered drive systems can be taken into water with rock hazards without the fear of destroying the propeller, such as with a gas-powered motor. Compared to oar-powered drive systems, pedal-powered drive systems allow the user to use his or her legs to power the watercraft, which provides a mechanical advantage that allows for reaching greater speeds in water compared to using an arm-powered oar.

While existing pedal-powered drive systems provide a number of advantages, they are also associated with a number of disadvantages. Current pedal-powered drive systems for watercraft typically have a single propeller and a single fixed-ratio drive gear. Thus, the speed that can be achieved is limited by the propeller design and the maximum rotations-per-minute that the user is able to exert. Additionally, current pedal-powered drive systems are positioned at a fixed depth in the water. Accordingly, their use is limited to water that is deep enough to handle the diameter of the propeller. Therefore, there exists a need in the art for an improved pedal-powered drive system for watercraft that overcomes the disadvantages of the existing drive systems.

SUMMARY OF THE DISCLOSURE

In view of the foregoing, a need exists for a stand-alone adjustable seat that is not integral or otherwise necessarily connected to the body of the small watercraft, such as a kayak or canoe. For example, the adjustable seat can be sold separately from any specific watercraft, and can be used with watercraft from various manufacturers. The adjustable seat can be used with any watercraft having a beam that is wide enough to accommodate the dimensions of the seat. The adjustable seat is not dependent upon the body of the watercraft to be either raised or lowered. Other than the points of contact where the seat is placed on the beam of the watercraft, no other point of contact between the seat and the watercraft is needed for the height of the seat to be adjusted.

In some examples, a drive assembly for providing motive power to a watercraft may include a manual drive mechanism configured for receiving mechanical input from a user and a motor drive mechanism configured for receiving mechanical input from a motor. The drive assembly may further include a driveshaft having a first end in selective engagement with one of the manual drive mechanism and the motor drive mechanism and a second end in engagement with a propeller. The drive assembly may further include a drive selector for selectively engaging the manual drive mechanism or the motor drive mechanism with the driveshaft based on a position of the drive selector between a first position and a second position. In the first position, the drive selector may engage the manual drive mechanism with a driveshaft for transferring the mechanical input from the user to the propeller, and, in the second position, the drive selector may engage the motor drive mechanism with the driveshaft for transferring the mechanical input from the motor to the propeller.

In other examples, engagement of one of the manual drive mechanism and the motor drive mechanism with the driveshaft may disengage the other of the manual drive mechanism and the motor drive mechanism. The manual drive mechanism may have a pair of pedals rotatable about a pedal axis for driving a pedal gear set. The pedal gear set may have a first pedal output gear in a geared engagement with a second pedal output gear by way of a pedal driveshaft. The second pedal output gear may be in a geared engagement with a first bevel gear on the driveshaft such that rotational movement of the pair of pedals results in a rotational movement of the driveshaft. The motor drive mechanism may have a motor output gear in a geared engagement with a second bevel gear on the driveshaft such that rotational movement of the motor results in a rotational movement of the driveshaft. The motor may be received within a motor housing portion and the motor may be movable within the motor housing portion from a first position to a second position. The motor may have a handle for moving the motor between the first position and the second position. A lock may be provided for locking a position of the motor at the first position or the second position. The lock may include one or more tabs on one of the motor and the motor housing portion configured for locking engagement with one or more recesses on the other of the motor and the motor housing portion. The drive selector may include a selector arm movable within a track on the motor drive mechanism and a selector shaft that is rotatable with movement of the selector arm to shift a selector sleeve between a first position, where the selector sleeve is engaged with the manual drive mechanism, and a second position, where the selector sleeve is disengaged from the manual drive mechanism.

In other examples, a dual drive system for providing motive power to a watercraft may include a frame configured for connecting to a supporting surface of the watercraft, and a drive assembly pivotally connected to the frame. The drive assembly may include a manual drive mechanism configured for receiving mechanical input from a user and a motor drive mechanism configured for receiving mechanical input from a motor. The drive assembly may further include a driveshaft having a first end in selective engagement with one of the manual drive mechanism and the motor drive mechanism and a second end in engagement with a propeller. The drive assembly may further include a drive selector for selectively engaging the manual drive mechanism or the motor drive mechanism with the driveshaft based on a position of the drive selector between a first position and a second position. In the first position, the drive selector may engage the manual drive mechanism with a driveshaft for transferring the mechanical input from the user to the propeller, and, in the second position, the drive selector may engage the motor drive mechanism with the driveshaft for transferring the mechanical input from the motor to the propeller.

In other examples, the drive assembly may have a main housing for receiving the manual drive mechanism and the powered drive mechanism, a skeg for enclosing the driveshaft, and a propeller housing for enclosing a propeller drive mechanism engagement of one of the manual drive mechanism and the motor drive mechanism with the driveshaft disengages the other of the manual drive mechanism and the motor drive mechanism. The drive selector may have a selector arm movable within a track on the motor drive mechanism and a selector shaft that is rotatable with movement of the selector arm to shift a selector sleeve between a first position, wherein the selector sleeve is engaged with the manual drive mechanism, and a second position, wherein the selector sleeve is disengaged from the manual drive mechanism. The frame may have a base with a pair of lower arms and a pair of upper arms, a first end of each lower arm and each upper arm configured for connecting to the housing of the drive assembly and a second end of each lower arm and each upper arm pivotally connected to the base. The pair of upper arms may be shorter in length than the pair of lower arms. The frame may further include a locking mechanism to lock at least one of the pair of lower arms and the pair of upper arms in a fixed position. The frame may further include a lift mechanism connected to at least one of the frame and the drive assembly for assisting in movement of the drive assembly between an extended position and a retracted position.

In other examples, a watercraft may have a hull having an interior with a supporting surface, and a dual drive system configured for providing motive power to the watercraft. The dual drive system may have a frame connected to the supporting surface, and a drive assembly connected to the frame. The drive assembly may have a manual drive mechanism configured for receiving mechanical input from a user and a motor drive mechanism configured for receiving mechanical input from a motor. The drive assembly may further include a driveshaft having a first end in selective engagement with one of the manual drive mechanism and the motor drive mechanism and a second end in engagement with a propeller. The drive assembly may further include a drive selector for selectively engaging the manual drive mechanism or the motor drive mechanism with the driveshaft based on a position of the drive selector between a first position and a second position. In the first position, the drive selector may engage the manual drive mechanism with a driveshaft for transferring the mechanical input from the user to the propeller, and, in the second position, the drive selector may engage the motor drive mechanism with the driveshaft for transferring the mechanical input from the motor to the propeller. At least a portion of the frame may be movable relative to the hull of the watercraft to move the drive assembly between a fully extended position, wherein the drive assembly is positioned such that the propeller is at a maximum insertion depth below the hull, and a fully retracted position, wherein the drive assembly is positioned such that the propeller is within the hull.

These and other features and characteristics of dual drive systems for watercraft, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only.

DETAILED DESCRIPTION OF THE PREFERRED EMBODIMENTS

Figure 1:
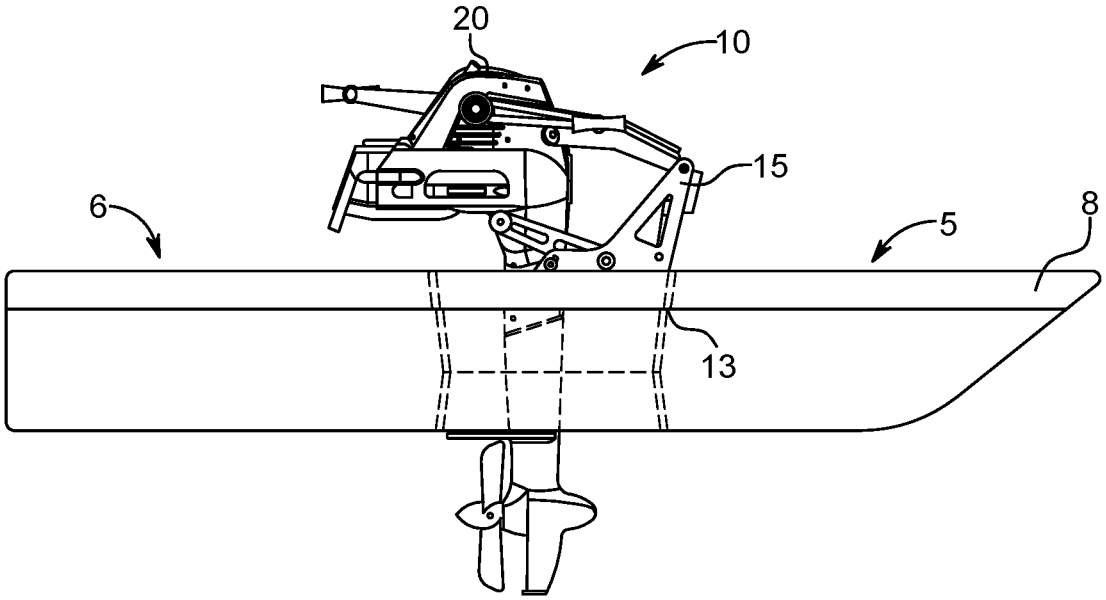
FIG. 1 is a side view of a watercraft having a dual drive system in accordance with one example of the present invention.

The illustrations generally show non-limiting examples of the devices and methods of the present disclosure. While the descriptions present various examples of the devices, it should not be interpreted in any way as limiting the disclosure. Furthermore, modifications, concepts, and applications of the disclosure's examples are to be interpreted by those skilled in the art as being encompassed, but not limited to, the illustrations and descriptions herein. Various modifications, equivalents, variations, and alternatives, however, will remain readily apparent to those skilled in the art. Any and all such modifications, variations, equivalents, and alternatives are intended to fall within the spirit and scope of the present disclosure.

As used herein, spatial or directional terms, such as "left", "right", "up", "down", "inner", "outer", "above", "below", "vertical", "horizontal", "longitudinal" and the like, relate to various features as depicted in the drawing figures. However, it is to be understood that various alternative orientations can be assumed and, accordingly, such terms are not to be considered as limiting.

As used herein, "geared engagement" refers to a meshing engagement of one or more gears.

Unless otherwise indicated, all ranges or ratios disclosed herein are to be understood to encompass any and all subranges or subratios subsumed therein. For example, a stated range or ratio of "1 to 10" should be considered to include any and all subranges between (and inclusive of) the minimum value of 1 and the maximum value of 10; that is, all subranges or subratios beginning with a minimum value of 1 or more and ending with a maximum value of 10 or less, such as but not limited to, 1 to 6.1, 3.5 to 7.8, and 5.5 to 10.

Unless otherwise indicated, all numbers expressing dimensions, quantities of ingredients, flow rates, pressures, and so forth used in the specification and claims are to be understood as modified in all instances by the term "about."

Referring to the drawings in which like reference characters refer to like parts throughout the several views thereof, the present disclosure is directed to a dual drive system for a watercraft, and more particularly to a dual drive system having a motor and a mechanical pedal system, wherein drive power can be selectively provided by the motor or by a user via the mechanical pedal mechanism.

With initial reference to FIG. 1, a dual drive system 10 (hereinafter referred to as "drive system 10") may be configured for use with a watercraft 5, such as a kayak, a canoe, or the like. The drive system 10 may be provided within an interior 6 of a hull 8 of the watercraft 5. In some examples, the drive system 10 may be supported on a supporting surface 13 within the interior 6 of the hull 8. The drive system 10 may be removably or non-removably connected to the watercraft 5. In some examples, the drive system 10 is removably connected to the watercraft 5. The drive system 10 may be releasably connected to the watercraft 5, such as by fasteners, clips, snaps, magnets, or other connection means. In other examples, the drive system 10 may be permanently installed in the watercraft 5. For example, at least a portion of the drive system 10 may be permanently and non-removably connected to the watercraft 5 by fasteners, welding, molding, or other connection means. In further examples, a first portion of drive system 10 may be permanently installed in the watercraft 5, while a second portion of the drive system 10 may be removably connected to the first portion and/or the watercraft 5. For example, the drive system 10 may have a frame 15 that is permanently installed in the watercraft 5 and a removable drive assembly 20 that is removably connectable to the frame 15.

Figure 2:
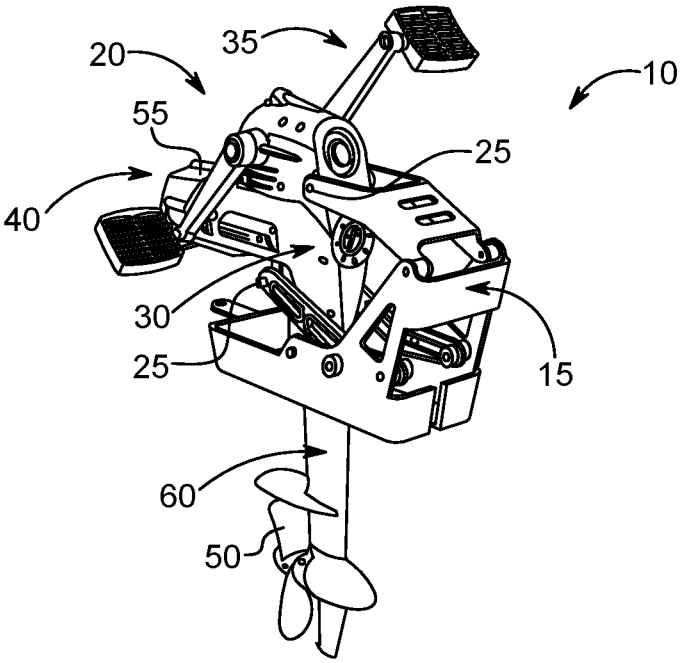
FIG. 2 is a perspective view of the dual drive system and a frame shown in FIG. 1.

With reference to FIG. 2, the drive system 10 is shown without the watercraft 5. The drive system 10 generally includes a frame 15 configured for installation on the watercraft 5. The frame 15 supports the drive assembly 20 of the drive system 10. In some examples, the drive assembly 20 may be removably connected to the frame 15, such as by one or more fasteners 25. In this manner, the frame 15 may remain connected to the watercraft 5 (shown in FIG. 1), while the drive assembly 20 may be removed from the frame 15 and the watercraft 5. In other examples, the drive assembly 20 may be removably connected to the frame 15 other mechanical means, such as a snap fit, one or more clips, interference fit, magnetic fit, and other forms of mechanical connection. In further examples, the drive assembly 20 may be non-removably connected to the frame 15, such that the drive assembly 20 and the frame 15 form a single, unitary structure.

With continued reference to FIG. 2, the drive assembly 20 has a main housing 30 for receiving the dual drive components of the drive assembly 20. In some examples, the main housing 30 receives a manual drive mechanism 35 and a motor drive mechanism 40. The manual drive mechanism 35 is configured to receive mechanical input from the user, such as through rotation of the pedals 45, and transfer this mechanical input into rotation of a propeller 50. The motor drive mechanism 40 is configured to receive mechanical input from a motor 55 and transfer this mechanical input into rotation of the propeller 50.

The manual drive mechanism 35 and the motor drive mechanism 40 may be operated individually (i.e., operation of one prevents operation of the other). For example, during operation of the manual drive mechanism 35, the motor drive mechanism 40 may be disconnected such that input from the motor 55 cannot be transferred to drive the propeller 50. In other examples, the manual drive mechanism 35 and the motor drive mechanism 40 may be operated synchronously such that the mechanical input by the user through rotation of the pedals 45 is supplemented by the mechanical input from the motor 55. In use, mechanical input from the user and/or the motor 55 is transferred by way of a driveshaft extending through a skeg 60. As described herein, one end of the driveshaft is connected to the manual drive mechanism 35 and/or the motor drive mechanism 40 and the opposing end of the driveshaft is operatively connected to the propeller 50 to cause rotation of the propeller 50 with the rotation of the pedals 45 or the motor 55.

Figure 3A:
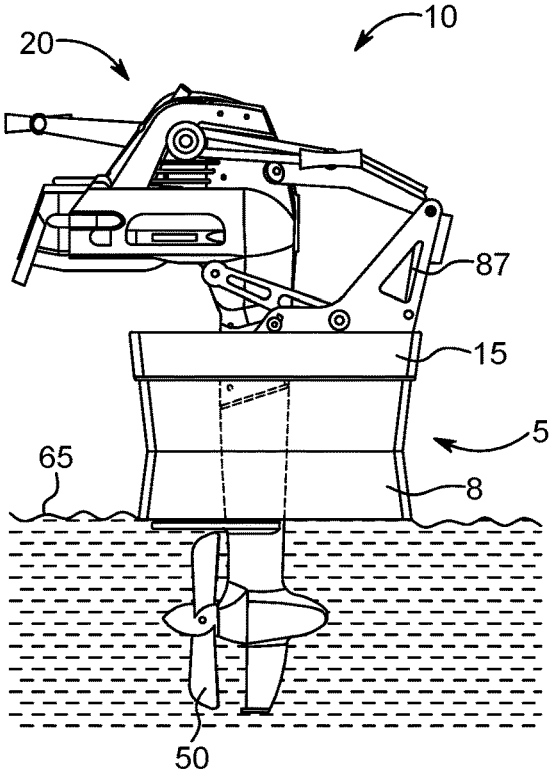
FIG. 3A is a side view of the dual drive system of FIG. 1 in a fully extended configuration.
Figure 3B:
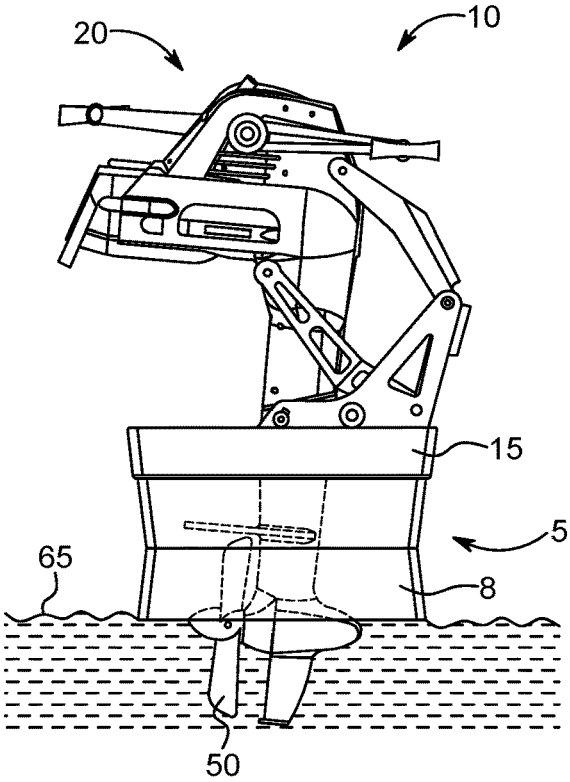
FIG. 3B is a side view of the dual drive system of FIG. 1 in a partially extended configuration.
Figure 3C:
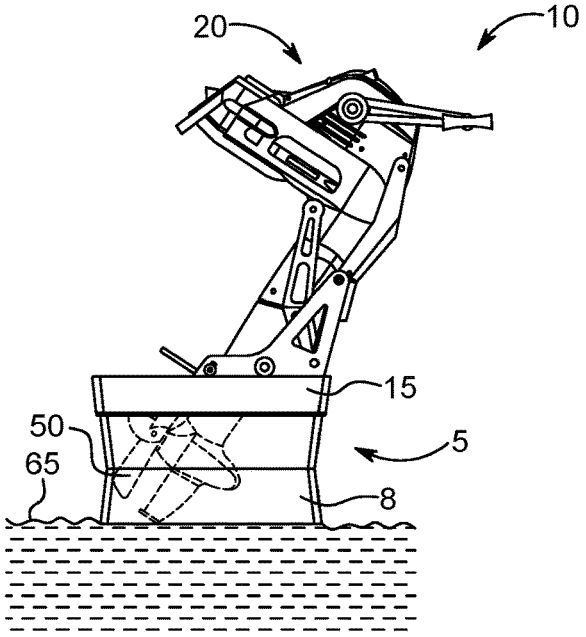
FIG. 3C is a side view of the dual drive system of FIG. 1 in a retracted configuration.

With reference to FIGS. 3A-3C, the frame 15 is configured to allow the drive assembly 20 to be lowered or raised relative to the hull 8 of the watercraft 5. In this manner, the propeller 50 can be lowered or raised to reduce the likelihood of impact between the propeller 50 and any underwater obstacles, such as rocks. At least a portion of the frame 15 may be movable relative to the hull 8 of the watercraft 5 to cause the drive assembly 20 to be moved between a fully extended position (FIG. 3A), a partially extended position (FIG. 3B), and a retracted position (FIG. 3C). In the fully extended position shown in FIG. 3A, the frame 15 and the drive assembly 20 are positioned such that the propeller 50 is at a maximum insertion depth below the surface of the water 65. In the partially extended position shown in FIG. 3B, the frame 15 and the drive assembly 20 are positioned such that the propeller 50 is at a minimum insertion depth below the surface of the water 65. In the fully retracted position shown in FIG. 3C, the frame 15 and the drive assembly 20 are positioned such that the propeller 50 is above the surface of the water 65 and within the hull 8. The frame 15 and the drive assembly 20 may have a finite number of settings between the fully extended position shown in FIG. 3A and the fully retracted position shown in FIG. 3B. In some examples, the frame 15 and the drive assembly 20 may be infinitesimally adjustable between the fully extended position shown in FIG. 3A and the fully retracted position shown in FIG. 3B.

Figure 4:
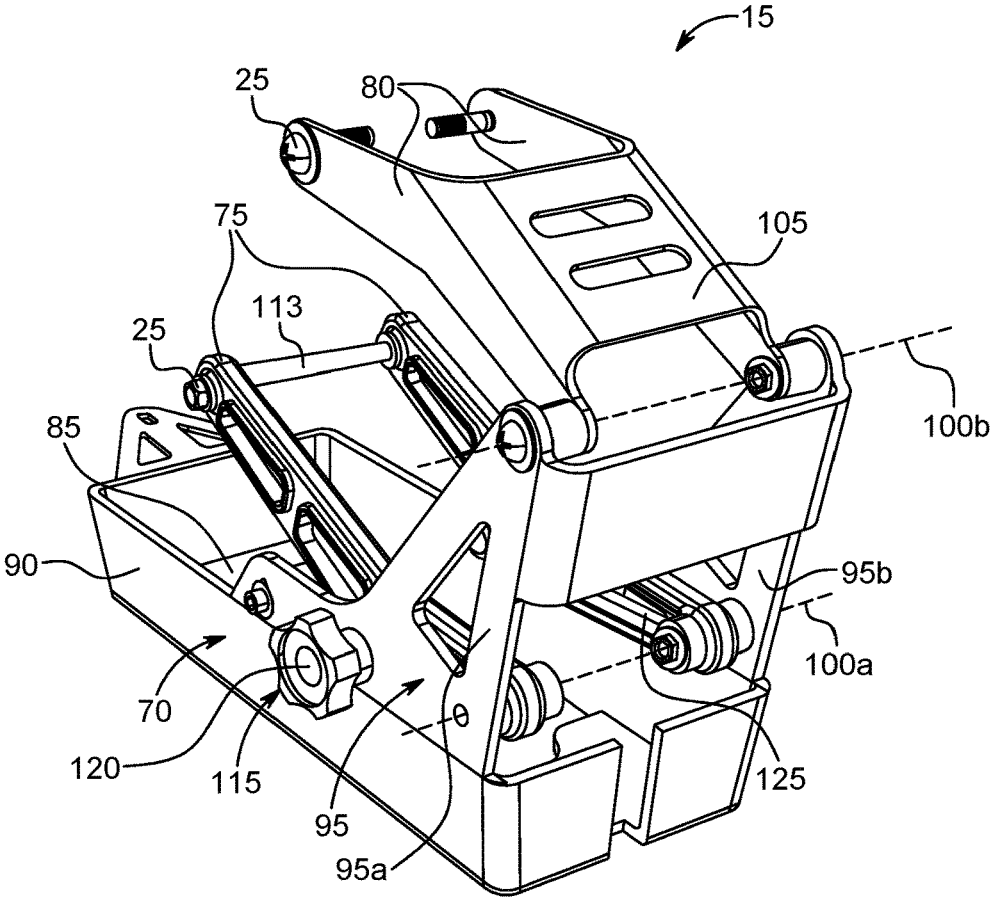
FIG. 4 is a perspective view of a frame for a dual drive system in accordance with one example.

With reference to FIG. 4, the frame 15 is shown with the drive assembly 20 removed therefrom. The frame 15 has a base 70 with a pair of lower arms 75 and a pair of upper arms 80. The drive assembly 20 may be removably connectable to each of the lower arms 75 and the upper arms 80. The base 70 is configured for attachment to the supporting surface 13 of the watercraft 5 (shown in FIG. 1). In some examples, the base 70 has a trough shape with a bottom surface 85 and one or more sidewalls 90 extending from the bottom surface 85. The base 70 further has a support portion 95 connected at least one of the sidewalls 90 and/or the bottom surface 85. The support portion 95 extends vertically upward from the bottom surface 85 and provides an attachment point for each of the upper arms 75 and the lower arms 80. In some examples, the support portion 95 has a first support portion 95*a* and a second support portion 95*b* provided opposite the first support portion 95*a*. The first of the pair of lower arms 75 and the upper arms 80 is connected to the first support portion 95*a*, while the second of the pair of lower arms 75 and the upper arms 80 is connected to the second support portion 95*b*.

In various examples, the pair of lower arms 75 and the pair of upper arms 80 are connected to the support portion 90 in a pivoting manner such that each of the arms is rotatable relative to the support portion 90 about a pivot axis. For example, a first end of the pair of lower arms 75 may be pivotally connected to the support portion 90 such that each of the lower arms 75 is rotatable about a first pivot axis 100*a*. Similarly, a first end of the pair of upper arms 80 may be pivotally connected to the support portion 90 such that each of the upper arms 80 is rotatable about a second pivot axis 100*b*. The first pivot axis 100*a* may be substantially parallel with the second pivot axis 100*b*.

With continued reference to FIG. 4, the pair of upper arms 80 may be connected together by a connecting portion 105. The connecting portion 105 may be provided between the first ends of the upper arms 80 at which the upper arms 80 are connected to the support portion 90 and the second ends of the upper arms 80 at which the upper arms 80 can be connected to the drive assembly 20. The second end of each upper arm 80 may have one or more fasteners 25 for connecting to the main housing 30 of the drive assembly 20. In some examples, the pair of lower arms 70 may be connected together by a connecting portion (not shown) in a manner similar to the connection portion 105 that connects the pair of upper arms 80. The pair of lower arms 75 may have a through-bolt 113 that connects the second ends of the lower arms 75. In some examples, the through-bolt 113 may be configured for insertion through at least a portion of the main housing 30 when the drive assembly 20 is connected to the frame 15. The second end of each lower arm 75 may have one or more fasteners 25 for connecting to the main housing 30 of the drive assembly 20.

The pair of upper arms 80 is configured to be shorter in length compared to the pair of lower arms 75 such that the upper arms 80 and the lower arms 75 together define a parallelogram with unequal top and bottom ends. When attached to the drive assembly 20, the pair of lower arms 75 and the pair of upper arms 80 are rotatable about their respective pivot axes in unison. Due to the difference in length between the pair of lower arms 75 and the pair of upper arms 80, the drive assembly 20 can be lifted and rotated toward a rear end of the watercraft 5 (see FIG. 3C) in one continuous motion. In some examples, the drive assembly 20 is moved between the extended position to a retracted position, and vice versa, by grabbing a handle on the drive assembly 20, as described herein, and lifting or lowering the drive assembly 20.

A lift mechanism 87 (shown in FIG. 3A) may be provided to assist in raising and/or lowering the drive assembly 20 relative to the frame 15. In some examples, the lift mechanism 87 may be connected at one end to the frame 15 and at the other end to the drive assembly 20. In other examples, one end of the lift mechanism 87 may be connected to the base 70 while the other end of the lift mechanism 87 may be connected to at least one of the lower arms 75 and/or the upper arms 85. The lift mechanism 87 is operative to provide a mechanical advantage to the user when raising and/or lowering the drive assembly 20 relative to the frame 15. In some examples, the lift mechanism 87 may be a powered lift mechanism. In other examples, the lift mechanism 87 may be at least one spring or a hydraulic or pneumatic cylinder.

The drive assembly 20 can be locked in a desired position, such as the fully extended, partially extended, or fully retracted position described herein with reference to FIGS. 3A-3C. A locking mechanism 115 may be provided to lock the lower and upper arms 75, 80 in a fixed position. In some examples, the locking mechanism 115 may have a retractable knob 120 with a pin (not shown) that engages a recess 125 on at least one lower arm 75 or upper arm 80. The knob 120 may be pushed to position the pin in the recess 125 to lock the position of the lower and/or upper arms 75, 80, and pulled to remove the pin from the recess 125 and allow the lower and/or upper arms 75, 80 to move. When engaged, locking mechanism 115 prevents movement of the lower and upper arms 75, 80 between the fully extended, partially extended, or fully retracted position. In various examples, the locking mechanism 115 may be provided to allow the lower and upper arms 75, 80 to be locked in a fully extended position, a fully retracted position, and/or any position between the fully extended and the fully retracted position.

Figure 5:
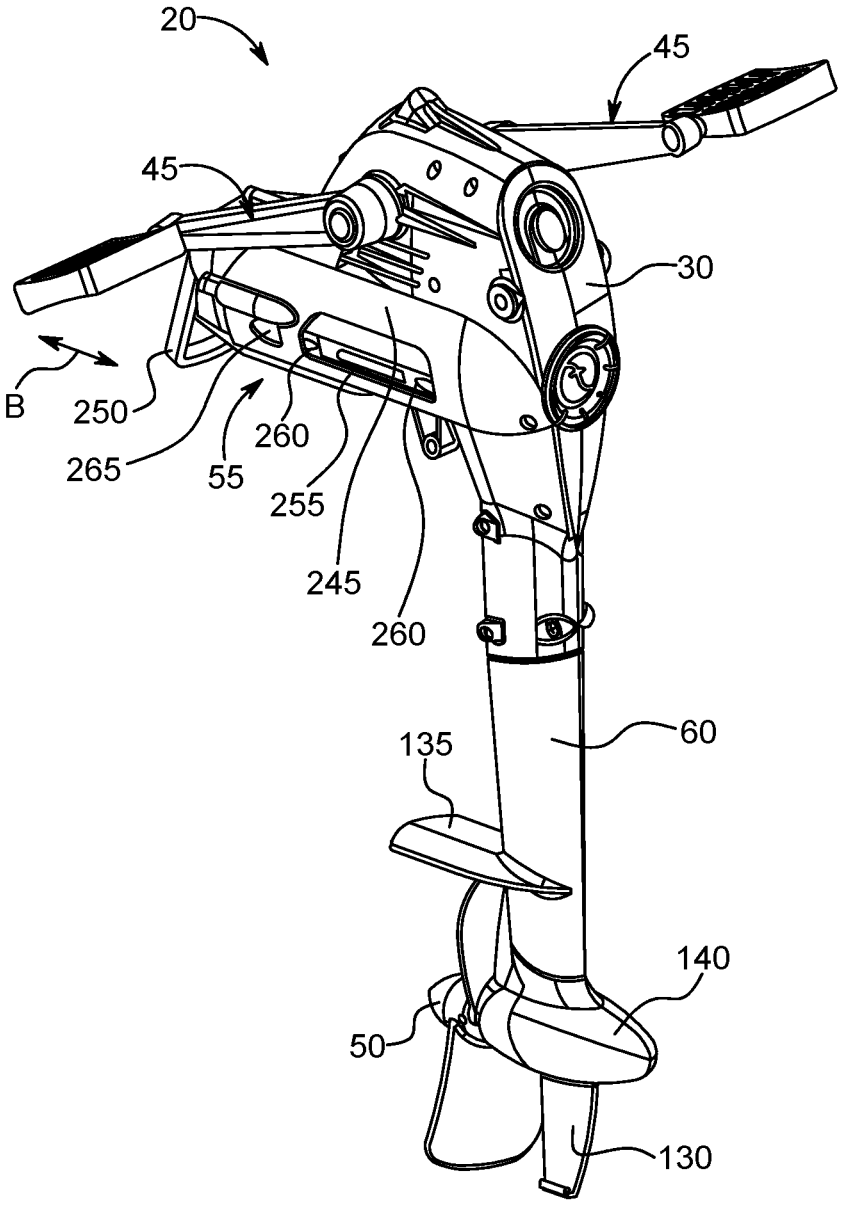
FIG. 5 is a perspective view of the dual drive system of FIG. 1 shown without the frame.

With reference to FIG. 5, the drive assembly 20 is shown without the frame 15. The drive assembly 20 has the main housing 30 for receiving the dual drive components of the drive assembly 20 shown in FIG. 6. The main housing 30 may support the pedals 45 and the motor 55. In some examples, the motor 55 may be removably connected to the main housing 30. When connected to the main housing 30, the motor may be movable relative to the main housing 30 between a first position and a second position. In various examples, the motor 55 may be operatively connected to the drive assembly 20 to drive the propeller 50 when the motor 55 is moved to the first position. The motor 55 may be disconnected from driving the propeller 50 when the motor 55 is in the second position.

With continued reference to FIG. 5, the skeg 60 is directly connected to the main housing 30. The skeg 60 has a hollow structure with a driveshaft extending therethrough to rotate the propeller 50. The skeg 60 may have a rudder 130 for controlling a direction of travel of the watercraft 5 (shown in FIG. 1) and at least one stabilizing element 135 for controlling a lateral stability of the watercraft 5. The skeg 60 further has a propeller housing 140 for enclosing the components of a propeller drive mechanism.

Figure 6:
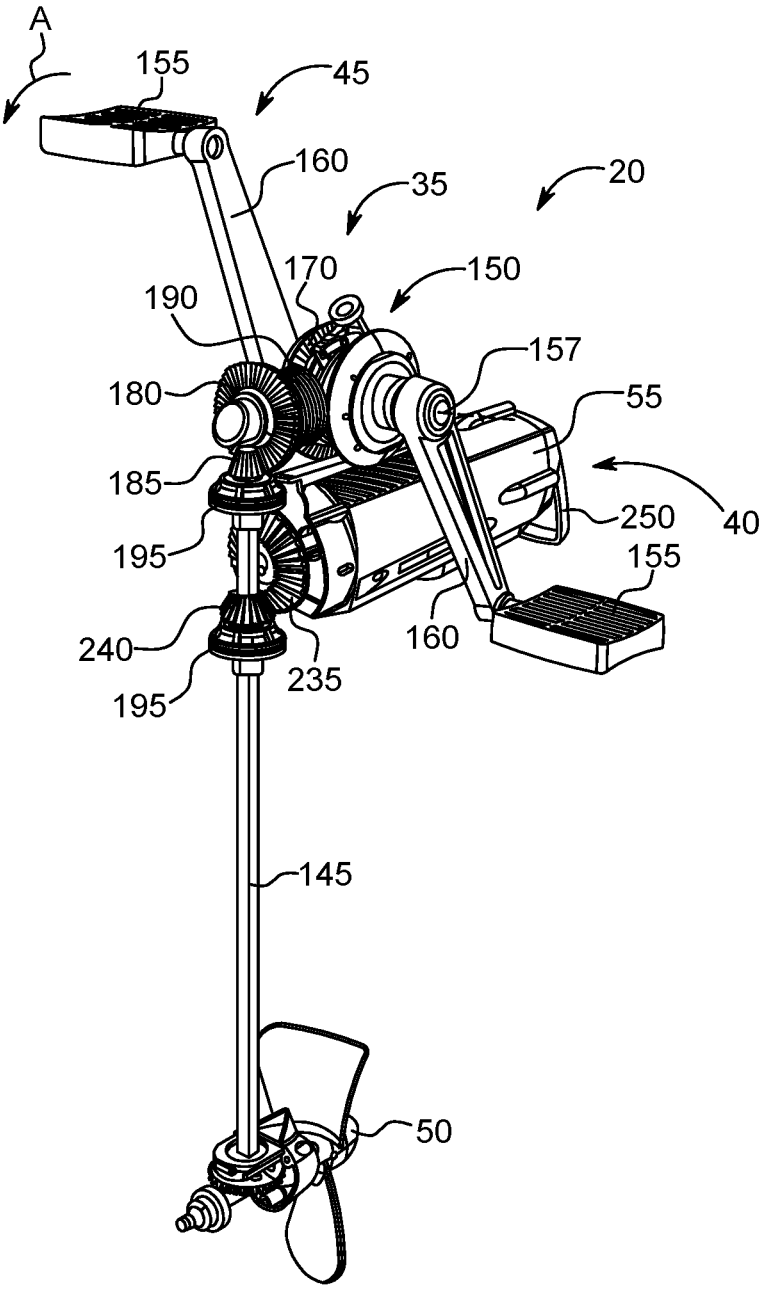
FIG. 6 is a perspective view of the dual drive system of FIG. 5 shown without an exterior housing.

With reference to FIG. 6, the drive assembly 20 is shown without the main housing 30. In some examples, the drive assembly 20 is configured to be operated between a manual mode and a powered mode. In some examples, the manual mode and the powered mode may be operated synchronously (i.e., simultaneously). When operated in the manual mode, the pedals 45 of the manual drive mechanism 35 transfer the mechanical input by the user into rotation of the propeller 50. In the powered mode, the motor 55 of the motor drive mechanism 40 transfers mechanical input into rotation of the propeller 50. Mechanical input from the user and/or the motor 55 is transferred by way of a driveshaft 145. As described herein, one end of the driveshaft 145 is connected to the manual drive mechanism 35 and/or the motor drive mechanism 40 and the opposing end of the driveshaft 145 is operatively connected to the propeller 50 to cause rotation of the propeller 50 with the rotation of the pedals 45 and/or the motor 55. In various examples, the driveshaft 145 can be operatively connected to the manual drive mechanism 35 and/or the motor drive mechanism 40 by way of one or more meshing gears.

With continued reference to FIG. 6, the manual drive mechanism 35 has a pair of pedals 45 positioned on opposite sides of a pedal gear set 150. The pedals 45 are rotatable about a pedal axis 157 in a direction of arrow A in FIG. 6. Each pedal 45 has a pedal platform 155 for supporting a user's foot and a pedal crank 160. The pedal crank 160 is connected at one end to the pedal platform 155 and at the other end to the pedal gear set 150. Rotation of the pedal crank 160 due to mechanical input received from the user's legs causes a corresponding rotation of the pedal gear set 150.

Figure 7:
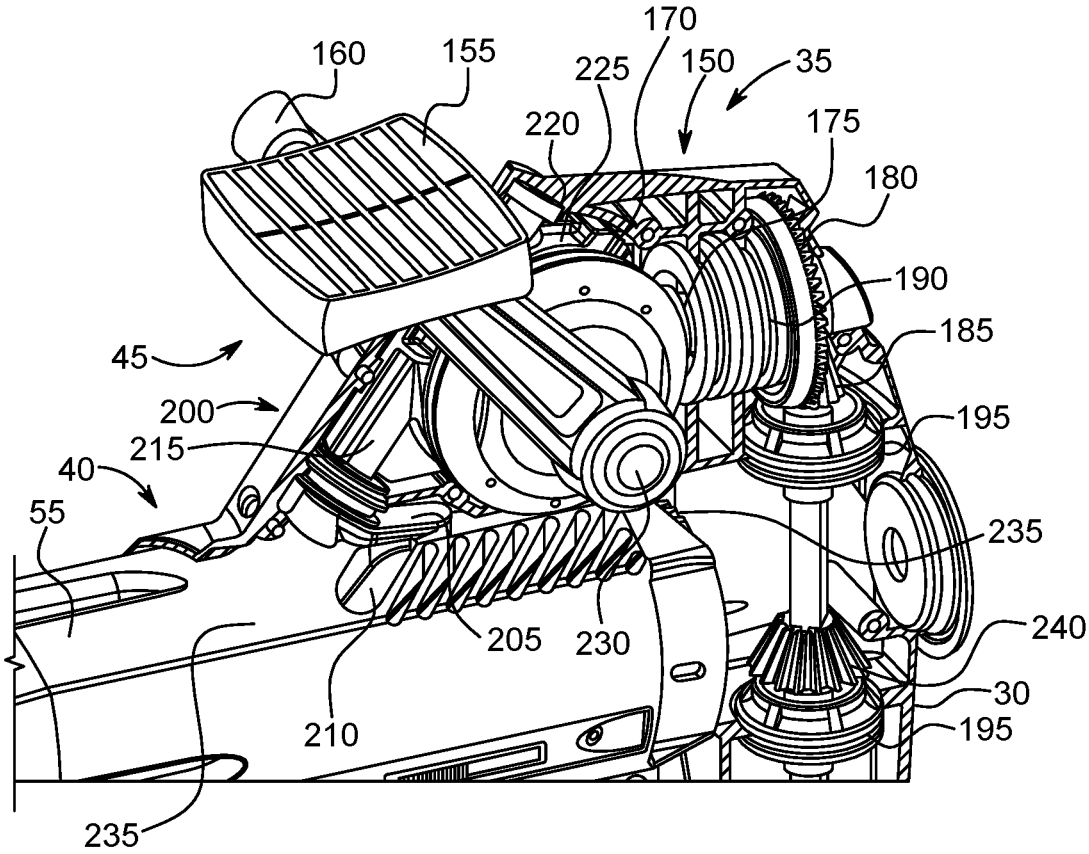
FIG. 7 is a detailed perspective view of a drive mechanism of the dual drive system of FIG. 5.

With reference to FIG. 7, the manual drive mechanism 35 may have a counterweight 165 for counterbalancing the rotational inertia of the rotating pedal assembly. The pedal gear set 150 has a first pedal output gear 170 that is geared engagement with a pedal driveshaft 175. Rotational movement of the first pedal output gear 170 due to rotation of the pedals 45 results in a corresponding rotation of the pedal driveshaft 175. In some examples, the first pedal output gear 170 and the pedal driveshaft 175 may have a gear ratio between 1:1 and 5:1, such as 3.4:1. In this manner, a single full rotation of the first pedal output gear 170 results in 3.4 rotations of the pedal driveshaft 175. The pedal driveshaft 175 has a second pedal output gear 180 that rotates with the rotation of the pedal driveshaft 175. The second pedal output gear 180 is in geared engagement with a first bevel gear 185 that is directly connected to the driveshaft 145. Rotational movement of the second pedal output gear 180 due to rotation of the pedal driveshaft 175 results in a corresponding rotation of the first bevel gear 185. In some examples, the second pedal output gear 180 and the first bevel gear 185 may have a gear ratio between 1:1 and 5:1, such as 3.3:1. In this manner, a single full rotation of the second pedal output gear 180 results in 3.3 rotations of the first bevel gear 185. When combined with the first gear ratio between the first pedal output gear 170 and the pedal driveshaft 175, the overall gear ratio between the first pedal output gear 170 and the driveshaft 145 is 11.1. In this manner, a single full rotation of the first pedal output gear 170 results in 11.1 rotations of the driveshaft 145. In some examples, the pedal gear set 150 may have one or more gears for multiplying the torque exerted by the user on the pedals 45. The pedal gear set 150 may have one or more bearings 190 for rotatably supporting the rotating components of the pedal gear set 150 within the main housing 30. Similarly, the driveshaft 145 may have one or more driveshaft bearings 195 along its longitudinal length for rotatably supporting the driveshaft 145 within the main housing 30.

With reference to FIGS. 6-7, the motor drive mechanism 40 has the motor 55 with its output shaft connected to a motor output gear 235. Rotation of the output shaft of the motor 55 causes a corresponding rotation of the motor output gear 235. The motor output gear 235 is in selective geared engagement with a second bevel gear 240. The second bevel gear 240 is connected to the driveshaft 145 such that rotation of the motor output gear 235 causes a corresponding rotational movement of the driveshaft 145 through geared engagement between the motor output gear 235 and the second bevel gear 240. The motor output gear 235 is selectively brought into geared engagement with the second bevel gear 240 depending on the position of the a drive selector, as described herein.

In various examples, the motor 55 may be an electric motor. Power to the motor 55 may be supplied by an on-board power source, such as a rechargeable battery (not shown). In other examples, the motor 55 may be an internal combustion engine. The motor 55 may be operated at a constant speed, such as 1 to 2,000 rpm. In some examples, the motor 55 may be operated at 1,000 rpm. In other examples, the motor 55 may have a plurality of user-selectable speed settings ranging from a minimum rotational speed and a maximum rotational speed.

With reference to FIG. 5, the motor 55 is received within a motor housing portion 245 of the main housing 30. In some examples, the motor 55 may be removable from the motor housing portion 245. When connected to the motor housing portion 245, the motor 55 may be movable relative to the motor housing portion 245 between a first position and a second position. A handle 250 may be provided as a gripping point for moving the motor 55 between the first position and the second position. In some examples, the motor 55 may be linearly movable within the motor housing portion 245 by pulling or pushing the handle 250 in a direction of arrow B shown in FIG. 5. A lock 255 may be provided on at least one of the motor 55 and the motor housing portion 245 to lock the motor 55 in the first position and/or the second position and therefore prevent movement of the motor 55 from the first position and/or the second position. In one example, the lock 255 may have one or more depressible tabs 260 on the motor 55 that engage one or more recesses 265 on the motor housing portion 245. The one or more depressible tabs 260 engage a corresponding recess 265 to position the motor 55 at a desired location relative to the motor housing portion 245. The lock 255, when engaged, prevents further movement of the motor 55 until the lock 255 is disengaged, such as by depressing one or more depressible tabs 260, to allow relative movement between the motor 55 and the motor housing portion 245. The position of the one or more tabs 260 and the corresponding recesses 265 may be reversed such that the one or more tabs 260 are provided on the motor housing portion 245 and the corresponding recesses 265 are provided on the motor 55.

With reference to FIG. 7, the drive assembly 20 has a drive selector 200 for selecting operation of the drive assembly 20 between a manual mode, wherein the drive assembly 20 is operated by rotation of the pedals 45, and a powered mode, wherein the drive assembly 20 is operated by rotational input provided by the motor 55. In some examples, the drive selector 200 may be manually operated to select the desired operating mode. For example, the drive selector 200 may be moved to a first position, wherein the drive assembly 20 is operated in a manual mode. In the manual mode, the motor 55 is disengaged from the drive assembly and does not provide motive power to the propeller 50. When moved to a second position different from the first position, the drive selector 200 causes the drive assembly 20 to be operated in a powered mode. In the powered mode, the pedals 45 are disconnected from providing motive power to the propeller 50. The drive selector 200 may have a selector arm 205 that is movable between a first position and a second position along a track 210 to cause the drive assembly 20 to be operated between the manual mode and the powered mode. Movement of the selector arm 205 may be effected by the user directly manipulating the selector arm 205, or by manipulating another component, such as the motor 55, to cause a corresponding movement of the selector arm 205 along the track 210.

With continued reference to FIG. 7, movement of the selector arm 205 along the track 210 causes a corresponding rotation of a selector shaft 215. The selector shaft 215 has a rod 220 that engages a selector sleeve 225. With the rotation of the selector shaft 215, the rod 220 is rotated such that it engages the selector sleeve 225 and causes the selector sleeve 225 to move between a first position (shown in FIG. 8C) and a second position (shown in FIG. 9C) along a pedal shaft 230. In the first position, the selector sleeve 225 connects the pedal shaft 230 to the first pedal output gear 170. In this manner, rotation of the pedals 45 causes a corresponding rotation of the first pedal output gear 170. With movement of the selector arm 205 along the track 210 to a second position, the selector shaft 210 and the rod 220 are rotated such that the rod 220 engages the selector sleeve 225 and causes the selector sleeve 225 to move to the second position (shown in FIG. 9C). In the second position, the selector sleeve 225 disconnects the first pedal output gear 170 from the pedal shaft 230 such that rotation of the pedals 45 does not cause a corresponding rotation of the first pedal output gear 170. In the second position, the pedals 45 may be rotated freely about the pedal axis 157 without a corresponding rotation of the manual drive mechanism 35. As described herein, when the selector arm 205 is moved to the second position, the motor 55 is operatively engaged with the driveshaft 145 to rotate the driveshaft 145 and the propeller 50.

In some examples, the track 220 may be provided on at least a portion of the motor 55, such as the motor housing 235. The track 220 defines a channel that restricts the movement of the selector arm 205 within the track 220 as the motor 55 is moved from a first position to a second position. The track 220 may have a curved or linear shape and extends substantially diagonal to a longitudinal direction L of the motor 55. In this manner, movement of the selector arm 205 along the track 220 causes a corresponding rotational movement of the selector shaft 215 about its axis, which causes a corresponding rotational movement of the rod 220 to move the selector sleeve 225.

Figure 10:
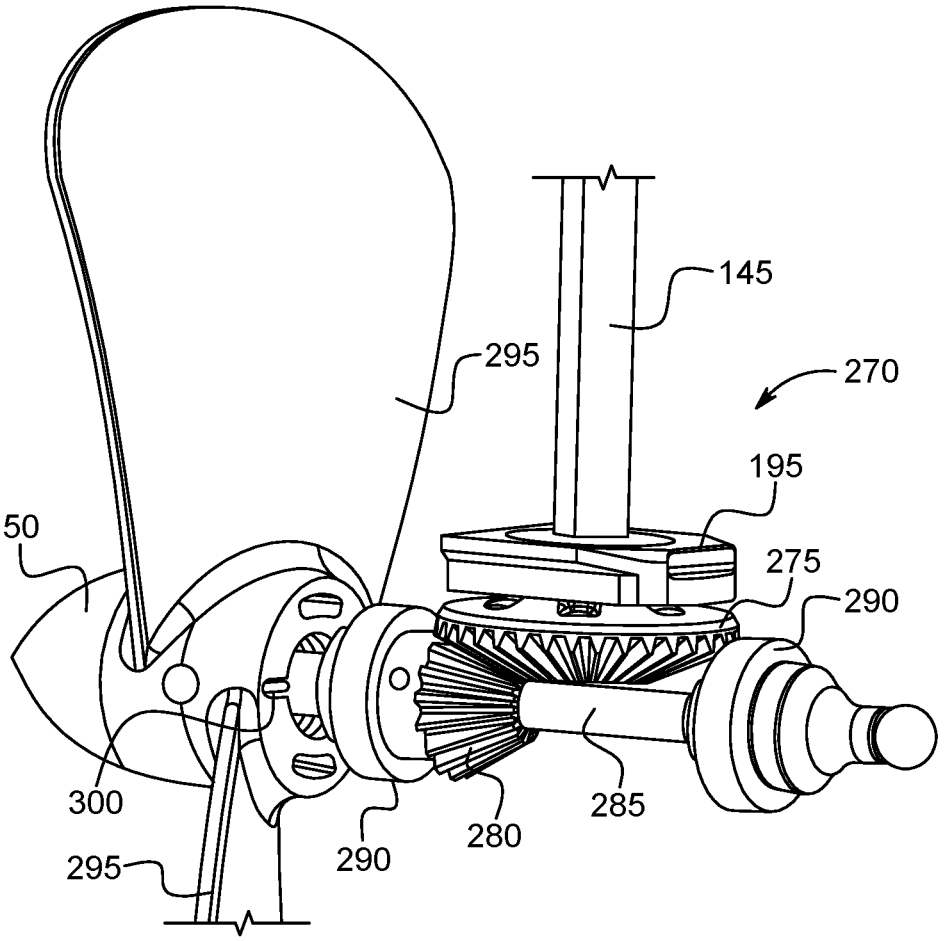
FIG. 10 is a perspective view of a propeller drive mechanism of the dual drive system.

With reference to FIG. 10, a propeller drive mechanism 270 is shown. A lower end of the driveshaft 145 has a driveshaft crown gear 275 that drives a propeller bevel gear 280. The lower end of the driveshaft 145 is supported within the propeller housing 140 (shown in FIG. 5) by a driveshaft bearing 195. Rotation of the driveshaft 145 causes a corresponding rotation of the driveshaft crown gear 275, which in turn rotates the propeller bevel gear 280. The propeller bevel gear 280 is mounted on a propeller shaft 285 that is supported within the propeller housing 140 (shown in FIG. 5) by a pair of propeller shaft bearings 290. The propeller 50 is mounted directly on the propeller shaft 285, such that rotation of the propeller shaft 285 causes a direct rotation of the propeller 50. The propeller 50 has at least a pair of propeller fins 295. In some examples, the propeller 50 may be connected to the propeller shaft 285 by a shear pin 300 that is configured to shear when the propeller impacts an underwater obstacle. In some examples, the propeller shear pin 300 may be configured to shear at a predetermined force. When the propeller shear pin 300 is sheared, the propeller 50 is disconnected from the propeller shaft 285. In this manner, damage to the gears is prevented if the propeller 50 is disabled due to impact with an underwater obstacle. The entire propeller drive mechanism 270 is desirably sealed within the propeller housing 140.

In some examples, the driveshaft crown gear 275 and the propeller bevel gear 280 may have a gear ratio between 1:1 and 3:1, such as 2.1:1. In this manner, a single full rotation of the driveshaft 145 results in 2.1 rotations of the propeller shaft 285 and the propeller 50. When combined with the overall gear ratio between the first pedal output gear 170 and the driveshaft 145 of 11.1 (when operated in the manual mode), the total combined ratio of the drive system 10 is 23.3. In this manner, a single full rotation of the first pedal output gear 170 results in 23.3 rotations of the propeller 50. Thus, a user pedaling at 45 rpm will turn the propeller at 1,050 rpm. With a motor drive ratio of 1.8:1, a motor rotating at 1,000 rpm will turn the propeller at 1,800 rpm.

Figure 8A:
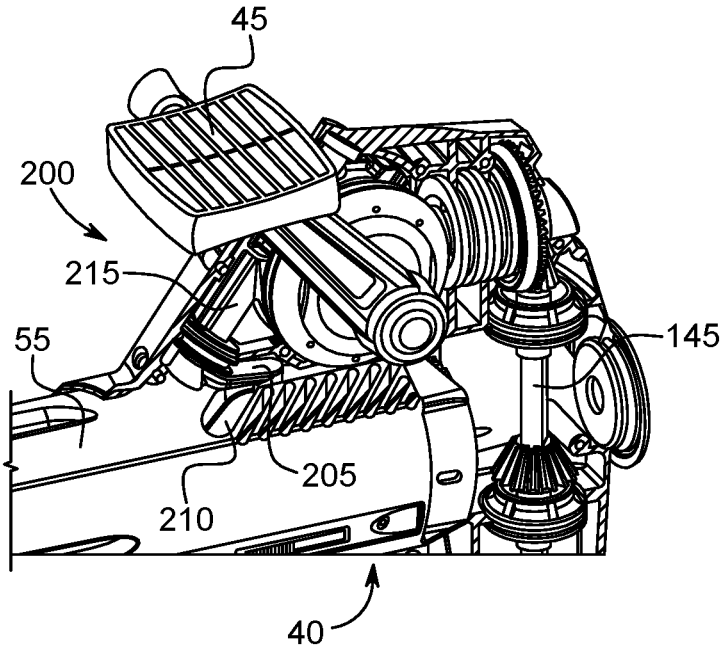
FIGS. 8A-8C show perspective views of a drive mechanism of the dual drive system in a first drive configuration.
Figure 8B:
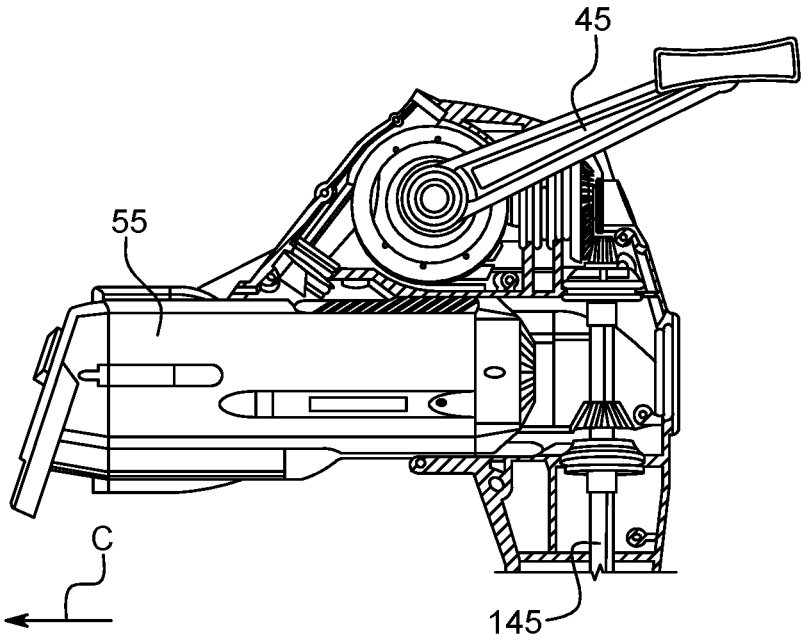
Figure 8C:
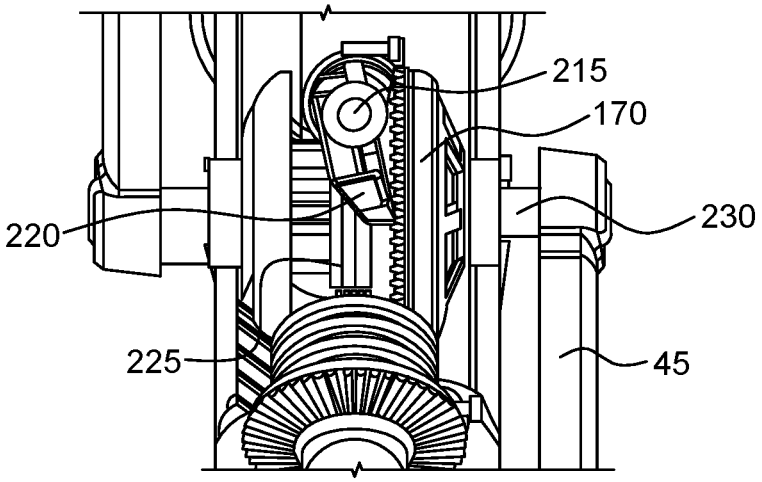

Having described the structure of the drive assembly 20, operation of the drive assembly 20 between a manual mode, wherein the propeller 50 is driven by mechanical input provided through the pedals 45 only, and a powered mode, wherein the propeller 50 is driven by mechanical input provided by the motor 55 only, will now be described with reference to FIGS. 8A-9C. To engage the manual mode, the drive selector 200 is operated to a first position, wherein the motor 55 is disconnected from driving the driveshaft 145. In some examples, the drive selector 200 may be operated to the first position by pulling the handle 250 on the motor 55 to pull the motor 55 in a direction away from the driveshaft 145, as shown by the arrow C in FIG. 8B. Movement of the motor 55 away from the driveshaft 145 also causes the selector arm 205 of the drive selector 200 to move to a first position within the track 210, as shown in FIG. 8A. In the first position of the selector arm 205, the selector shaft 215 is positioned such that the rod 220 of the selector shaft 215 engages the selector sleeve 225 and urges the selector sleeve 225 to move along the pedal shaft 230 such that the selector sleeve 225 connects the pedal shaft 230 to the first pedal output gear 170, as shown in FIG. 8C. In this manner, rotation of the pedals 45 causes a corresponding rotation of the first pedal output gear 170. This rotation of the first pedal output gear 170 is transferred by a geared connection to the propeller 50 to rotate the propeller 50, as described herein. The watercraft 5 (shown in FIG. 1) can thus be powered by manually rotating the pedals 45.

Figure 9A:
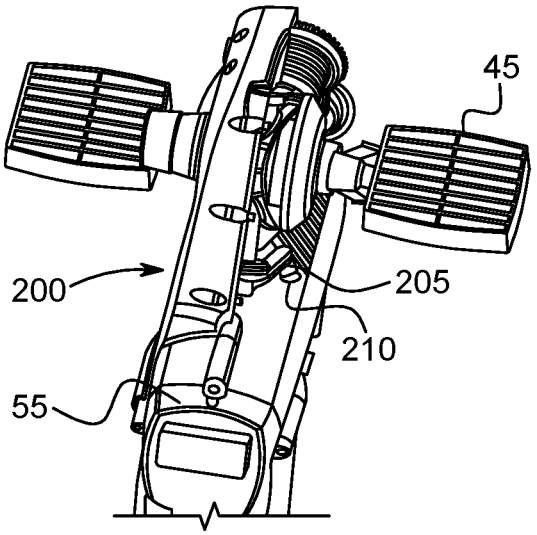
FIGS. 9A-9C show perspective views of a drive mechanism of the dual drive system in a first drive configuration.
Figure 9B:
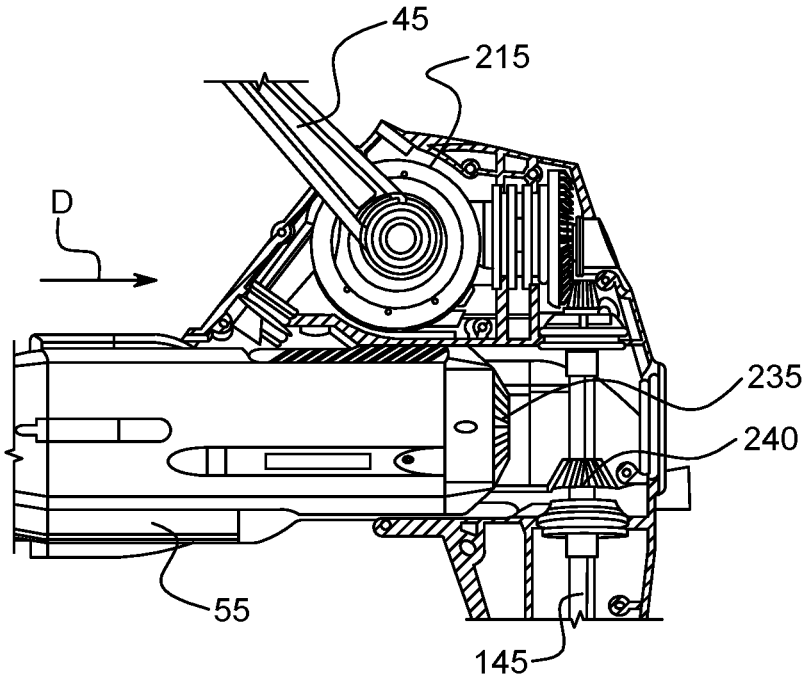
Figure 9C:
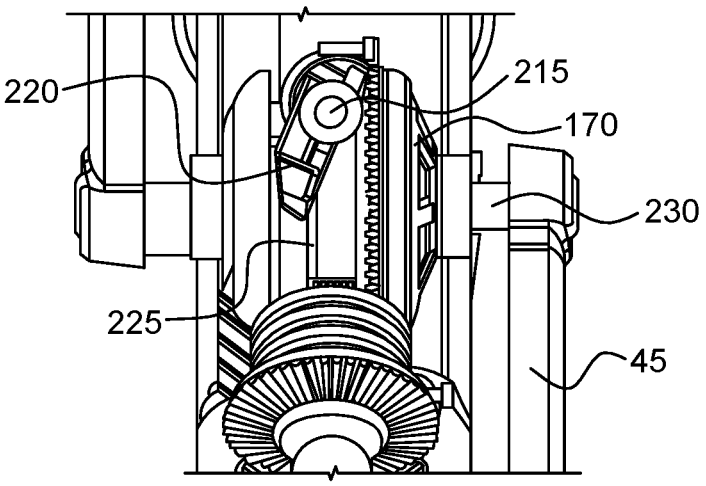

To effect a powered mode of operation, wherein the motor 55 of the motor drive mechanism 40 transfers mechanical input into rotation of the propeller 50, the drive selector 200 is operated to a second position, wherein the pedals 45 are disconnected from driving the driveshaft 145. In some examples, the drive selector 200 may be operated to the second position by pushing the handle 250 on the motor 55 to move the motor 55 in a direction toward from the driveshaft 145, as shown by the arrow D in FIG. 9B. Movement of the motor 55 toward the driveshaft 145 also causes the selector arm 205 of the drive selector 200 to move to a second position within the track 210, as shown in FIG. 9A. In the second position of the selector arm 205, the selector shaft 215 is positioned such that the rod 220 of the selector shaft 215 engages the selector sleeve 225 and urges the selector sleeve 225 to move along the pedal shaft 230 such that the selector sleeve 225 disconnects the pedal shaft 230 from the first pedal output gear 170, as shown in FIG. 9C. In this manner, rotation of the pedals 45 does not cause a corresponding rotation of the first pedal output gear 170. Instead, when the selector arm 205 is moved to the second position, the motor 55 is operatively engaged with the driveshaft 145 by way of the motor output gear 235 and the second bevel gear 240 to rotate the driveshaft 145 and the propeller 50, as described herein. The watercraft 5 (shown in FIG. 1) can thus be powered by the motor 55.

Although the disclosure has been described in detail for the purpose of illustration based on what is currently considered to be the most practical and preferred examples, it is to be understood that such detail is solely for that purpose and that the disclosure is not limited to the disclosed examples, but, on the contrary, is intended to cover modifications and equivalent arrangements. For example, it is to be understood that the present disclosure contemplates that, to the extent possible, one or more features of any example can be combined with one or more features of any other example.

What is claimed is:

1. A watercraft comprising a hull having a propeller;

a frame connected to the hull and movable between a fully extended position for lowering the propeller to a maximum insertion depth below the hull, and a fully retracted position for raising the propeller within the hull;

a drive assembly operatively connected to the propeller, the drive assembly having a motor drive mechanism for rotating the propeller; and a drive selector arm movable from an engaged position, wherein the drive selector arm engages the drive assembly such that the motor drive mechanism is operatively connected to the propeller, and a disengaged position, wherein the drive selector arm disengages the drive assembly such that the motor drive mechanism is disconnected from the propeller, wherein the motor drive mechanism has a motor with an output shaft in mechanical connection with the propeller when the drive selector arm is in the engaged position, and wherein the motor is received within a motor housing portion, and wherein the motor is translatable within the motor housing portion from a first position to a second position.

2. The watercraft of claim 1, wherein the motor drive mechanism rotates the propeller by way of a driveshaft.

3. The watercraft of claim 1, wherein the motor is in a geared engagement with a bevel gear on a driveshaft connected to the propeller such that the driveshaft rotates with rotational movement of the motor.

4. The watercraft of claim 1, wherein the motor is an electric motor powered by a battery.

5. The watercraft of claim 4, wherein the battery is a rechargeable battery.

6. The watercraft of claim 1, wherein the motor has a plurality of user-selectable speed settings between a minimum rotational speed and a maximum rotational speed.

7. The watercraft of claim 1, wherein the drive assembly has a motor housing portion for receiving the motor drive mechanism.

8. The watercraft of claim 1, wherein the drive assembly is removably connected to the hull by one or more fasteners.

9. A watercraft comprising a hull having a propeller;

a frame connected to the hull and movable between a fully extended position for lowering the propeller to a maximum insertion depth below the hull, and a fully retracted position for raising the propeller within the hull;

a drive assembly connected to the propeller by a driveshaft, the drive assembly having a motor with an output shaft connected to the driveshaft for rotating the propeller; and a drive selector arm movable from an engaged position, wherein the drive selector arm engages the drive assembly such that the motor is connected to the driveshaft, and a disengaged position, wherein the drive selector arm disengages the drive assembly such that the motor is disconnected from the driveshaft, wherein the motor is received within a motor housing portion, and wherein the motor is translatable within the motor housing portion from a first position to a second position.

10. The watercraft of claim 9, wherein the motor is in a geared engagement with a bevel gear on a driveshaft connected to the propeller such that the driveshaft rotates with rotational movement of the motor.

11. The watercraft of claim 9, wherein the motor is an electric motor powered by a battery.

12. The watercraft of claim 11, wherein the battery is a rechargeable battery.

13. The watercraft of claim 9, wherein the motor has a plurality of user-selectable speed settings between a minimum rotational speed and a maximum rotational speed.

14. A drive assembly for providing motive power to a watercraft, the drive assembly comprising:

a motor drive mechanism having a motor for rotating the propeller; and a drive selector arm movable from an engaged position, wherein the drive selector arm operatively connects the motor drive mechanism to the propeller, and a disengaged position, wherein the drive selector arm disengages the motor drive mechanism from the propeller, wherein the motor is received within a motor housing portion, and wherein the motor is translatable within the motor housing portion from a first position to a second position.

15. The drive assembly of claim 14, wherein the motor is an electric motor powered by a rechargeable battery.

16. The drive assembly of claim 14, wherein the motor has a plurality of user-selectable speed settings between a minimum rotational speed and a maximum rotational speed.

* * * * *